United States Patent [19]

Tamba et al.

[11] Patent Number: 4,922,881

[45] Date of Patent: May 8, 1990

[54] BREATHER DEVICE FOR AN INTERNAL COMBUSTION ENGINE

[75] Inventors: Shinichi Tamba, Kobe; Yoshiteru Ueda, Kakogawa, both of Japan

[73] Assignee: Kawasaki Jukogyo Kabushiki Kaisha, Japan

[21] Appl. No.: 286,996

[22] Filed: Dec. 20, 1988

[30] Foreign Application Priority Data

Dec. 29, 1987 [JP] Japan ..... 62-200616

[51] Int. Cl.[5] ..... F01M 9/10; F02M 25/06

[52] U.S. Cl. ..... 123/572; 123/90.34

[58] Field of Search ..... 123/41.86, 90.34, 572, 123/573, 574

[56] References Cited

U.S. PATENT DOCUMENTS

| | | | |
|---|---|---|---|
| 4,553,510 | 11/1985 | Yano et al. | 123/90.34 |
| 4,569,323 | 2/1986 | Okumura | 123/572 |
| 4,570,587 | 2/1986 | Watanabe et al. | 123/196 W |
| 4,603,673 | 8/1986 | Hiraoka et al. | 123/573 |
| 4,615,310 | 10/1986 | Umeha et al. | 123/90.34 |
| 4,651,704 | 3/1987 | Sekiguchi | 123/572 |
| 4,681,068 | 7/1987 | Anno et al. | 123/41.86 |
| 4,777,842 | 10/1988 | Yamada | 123/90.34 |

FOREIGN PATENT DOCUMENTS 0002256 8/1982 Japan .

*Primary Examiner*—Willis R. Wolfe
*Assistant Examiner*—M. Macy

[57] ABSTRACT

A breather device adapted for an internal combustion engine which includes a lubricant separation chamber having a check valve opening by a positive pressure in the crank chamber and being provided with hole(s) communicating the lubricant separation chamber with a crank chamber, a gas exhausting section connected to an intake air line, and with a device for returning a separated lubricant to the crank chamber. The lubricant return device comprises a gap section communicating to a bottom of the lubricant separation chamber and in contact with an end face of an appropriate revolving shaft such as a cam shaft, and forced oil return passage(s) being formed in or on said revolving shaft, which communicate(s) the crank chamber to the gap section, and integrally rotate(s) with the revolving shaft to forcibly send lubricant oil deposited in the gap section to the crank chamber.

5 Claims, 3 Drawing Sheets

BREATHER DEVICE FOR AN INTERNAL COMBUSTION ENGINE

BACKGROUND OF THE INVENTION

This invention relates to a breather device for an internal combustion engine.

The breather device according to the prior art used in the internal combustion engine is so designed as to take a blowby gas into the lubricant separation chamber through the intake opening with or without the check valve, separate the oil entrained in the blowby gas in the separation chamber, and return the separated oil to the crank chamber through the return holes in the bottom of the separation chamber, as shown in U.S. Pat. Nos. 4,569,323, 4,603,673, 4,681,068 etc.

However, by the method simply with the return holes only formed in the bottom of the separation chamber, the oil collected in the bottom of the separation chamber will scatter, because the blowby gas flows at a high speed into the lubricant separation chamber not only from the check valve portion but also from the return holes when the pressure in the crank chamber is increasing (at the positive pressure).

Such a phenomenon will cause the amount of oil discharged into the intake air line to be increased, the air cleaner and the intake air passage to be fouled, blocked and dripped with oil, and eventually the consumption of lubricant to increase. Further, the fouling of the air cleaner will result in a loss of supply of combustion air, thus leading to a deterioration of engine performance.

In order to prevent the air cleaner from fouling, there is known the Japanese laid open utility model No. Sho61-2256, in which the breather device has return holes so slender as to decelerate the air speed flowing into the separation chamber when the pressure in the crank chamber is increasing, to prevent oil from scattering, but this invention also cannot fully return oil into the crank chamber through the slender return holes.

A breather arrangement for a cam case of an internal combustion engine is also disclosed in U.S. Pat. No. 4,651,704, which includes a hollow cam shaft disposed in the cam case, and formed a bore as a lubricant separation chamber extending axially therethrough, at least one blow-by gas inlet opening for admitting blow-by gas in the cam case, and at least one oil discharging opening for discharging oil which is deposited in the bore; and a breather pipe to one end of which the bore of the hollow cam shaft is communicated, the other end of the breather pipe communicating to an intake system of the engine.

In this case, however, there is a possibility of admitting the blow-by gas into the breather pipe before the entrained oil is separated from the blow-by gas by centrifugal forces due to rotation of the cam shaft.

OBJECT AND SUMMARY OF THE INVENTION

The objects of the invention are to provide a breather device which can (1) prevent an air cleaner from fouling, blocking and dripping with oil, by forcibly and effectively returning an oil accumulated in a separation chamber, and also prevent engine performance from deteriorating due to a loss of combustion air, (2) save a consumption of lubricant, and (3) reasonably lubricate bearings for a revolving shaft using a lubricant in the separation chamber.

To achieve the above-described objects, this invention provide a breather device adapted for an internal combustion engine in which a lubricant separation chamber is intercommunicated with a crank chamber through a check valve opening by a positive pressure in the crank chamber, as well as provided with a gas exhausting section connected to an intake air line, and with means for returning a separated lubricant to the crank chamber, the means for returning the lubricant comprising:

a gap section being communicated to a bottom of the lubricant separation chamber and in contact with an end face of an appropriate revolving shaft, and forced oil return passage(s) being formed in or on the revolving shaft, which open(s) to the crank chamber through the above-described intercommunicating gap section, and revolve(s) with a rotation of the revolving shaft to forcibly send lubricant oil residing in the gap section to the crank chamber.

The above configuration permits a blowby gas trapping a lubricant oil to flow into a lubricant separation chamber through a check valve when a pressure in the crank chamber is increasing (at a positive pressure), thereby separating oil from the blowby gas in the separation chamber. A gas separated of oil is sent to the intake air line through the gas exhausting section, while the oil gathers on the bottom of the separation chamber.

The oil on the bottom drops down on a gap section at a end face of a revolving shaft (such as a cam shaft), and is forcibly thrown into the crank chamber through a forced oil return passage being revolved by the revolution of the revolving shaft.

Therefore, when the pressure in the crank chamber is increasing (at a positive pressure), there is no chance in which a blowby gas in the crank chamber flows back into the forced oil return passage, thus preventing oil on the bottom of the separation chamber from scattering as seen in the prior art.

Other objectives and advantages of the invention will become apparent from the following description, referring to the accompanied drawings.

DETAILED DESCRIPTION OF PREFERRED EMBODIMENTS

Figure 1:
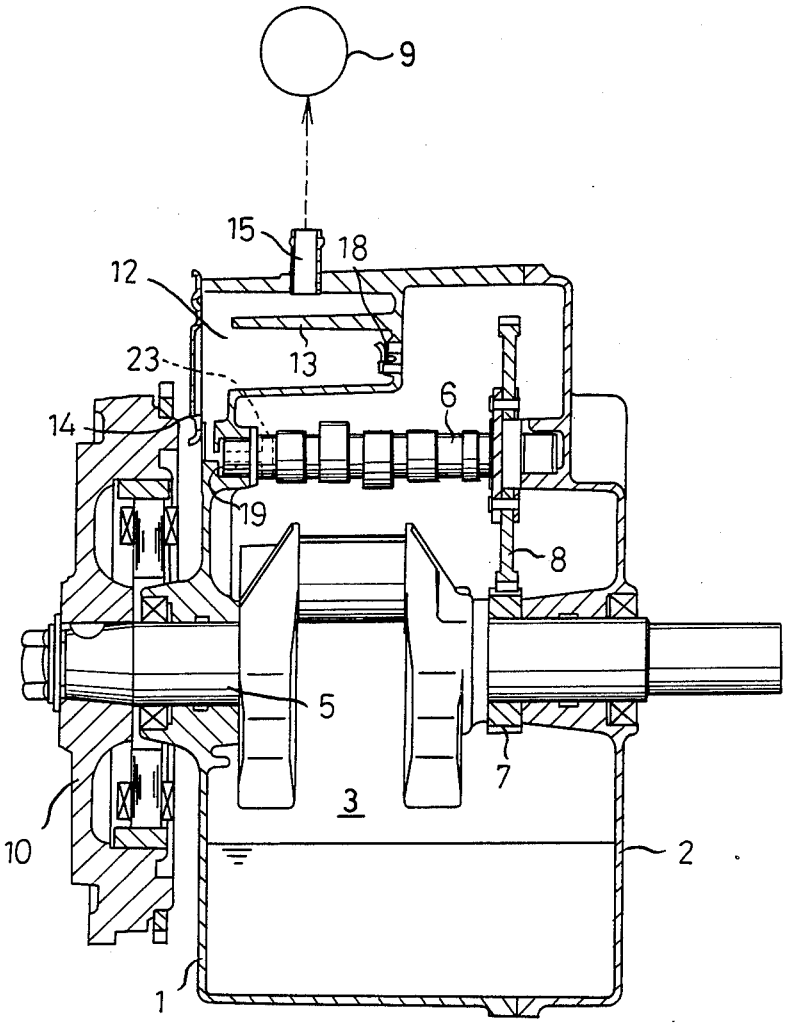
FIG. 1 is a vertical sectional view of a first embodiment of an internal combustion engine according to the invention.

The embodiments according to the invention is described in detail referring to the drawings:

FIG. 1 is a vertical sectional view of a first embodiment of an internal combustion engine according to the invention. In FIG. 1, a crank chamber 3 is defined by a crankcase 1 and a cover 2. In the crank chamber 3 a crankshaft 5 is disposed rotatably, and above the crankshaft 5 a cam shaft 6 is also disposed rotatably. The cam shaft 6 is interlockingly engaged with the crankshaft 5 through a cam shaft gear 8 and a crank gear 7. Numeral 10 is a flywheel.

At an upper portion of the crankcase 1 is formed an oil separation chamber 12, in which a baffle plate 13 is also formed to improve air-liquid separation. At an upper end of the separation chamber 12 a gas exhausting opening 15 is formed to communicate with an intake air line such as an air cleaner 9. Numeral 14 is a side cover of the separation chamber 12.

Figure 2:
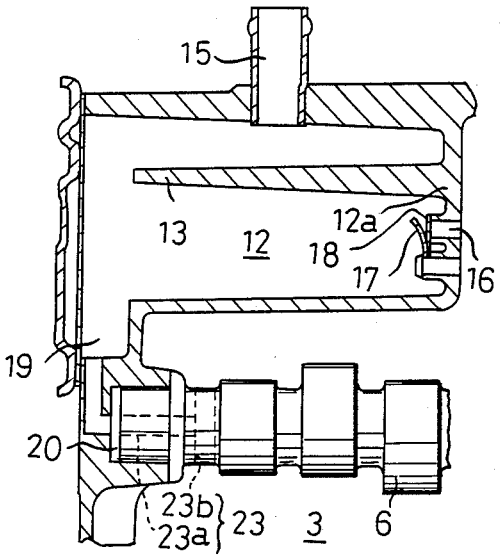
FIG. 2 is an enlarged view of main sections in FIG. 1.

FIG. 2 is an enlarged view of the separation chamber 12 in FIG. 1. In FIG. 2, in an axial-direction side end wall 12*a* of the separation chamber 12 an opening 16 is formed to communicate the separation chamber 12 with the crank chamber 3. To the opening 16 a check valve (leed valve) 18 is attached to open when a pressure in the crank chamber 3 is increased (at a positive pressure). To the check valve 18 is attached a stopper 17 to limit an opening degree thereof.

On a bottom portion of the separation chamber 12, an oil sump 19 is formed on an axial-direction opposite side to the above-described opening 16. At an axial-direction end face of the cam shaft 6 locating under the above-described oil sump 19 is formed a gap section 20, which communicates with an lower end section of the oil sump 19.

At the axial-direction end section of the cam shaft 6 is formed a forced oil return passage 23, which consists of a first passage 23*a* extending along the axis of the cam shaft 6 to open to the gap section 20 at one end thereof, and two or more second passages 23*b* radially extending at the other end of the first passage to open to the crank chamber 3.

The operation is as follows: While the engine is rotating, a descending stroke of the piston (not shown) increases a pressure in the crank chamber 3. When the descending stroke makes the pressure positive, a blowby gas in the crank chamber 3 with a positive pressure will thrust open the check valve 18, to pass into the oil separation chamber 12 through the opening 16, wherein oil entrapped in the blowby gas will run against the check valve 18 restricted by the stopper 17 to be separated from the gas, and further be separated by the action of the baffle plate 13 etc. in the separation chamber 12. The gas fraction is sent from the gas exhausting opening 15 to the air cleaner 9, and the oil fraction accumulates in the oil sump 19 at the bottom portion of the separation chamber 12.

The oil in the oil sump 19 drops down into the gap section 20, and reaches the first passage 23*a* of the forced oil return passage 23. A centrifugal force due to the rotation of the cam shaft 6 feeds the oil through the second passages 23*b* to the outward thereof in the radial direction, eventually throwing the oil out forcibly into the crank chamber 3.

Figure 3:
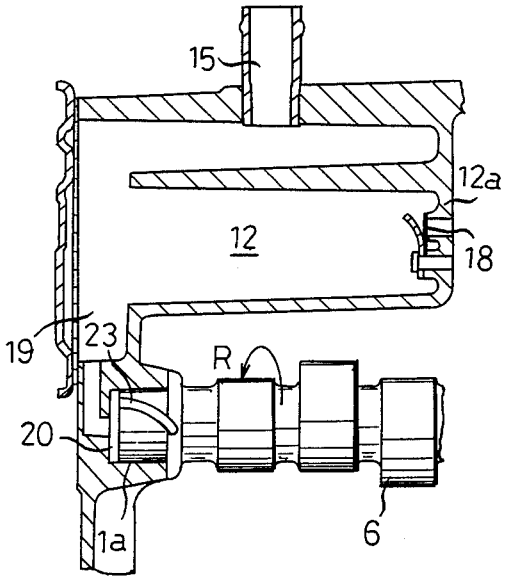
FIG. 3 is an enlarged view of main sections of a second embodiment.

Next, the second embodiment is described referring to FIG. 3. With this embodiment, as a forced oil return passage 23, a spiral groove is formed on a circumferential surface of the cam shaft journal inserting into a bearing section 1*a* to communicate a gap section 20 to a crank chamber 3. A twisting direction of the spiral forced oil return passage 23 is taken to an advance side of the cam shaft rotation direction as shown by "R" in FIG. 3 as the passage goes to the gap section.

In other words, with the configuration in FIG. 3, the rotation in the "R" direction of the cam shaft 6 can provide the spiral forced oil return passage 23 with a function similar to a screw pump, thereby forcibly returning oil into the crank chamber 3 from the gap section 20.

Figure 4:
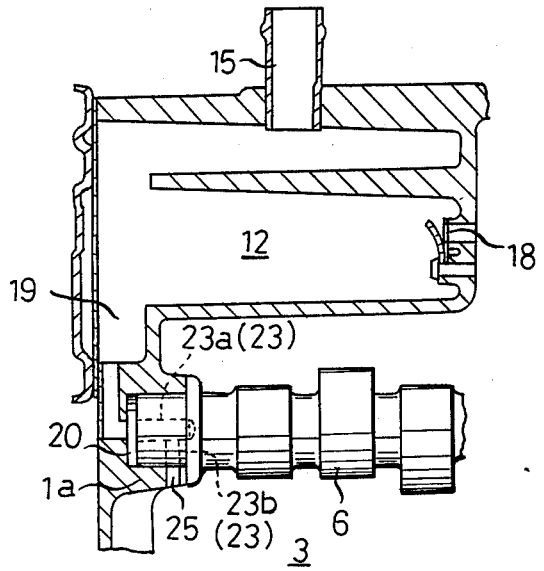
FIG. 4 is an enlarged view of main sections of a third embodiment.
Figure 5:
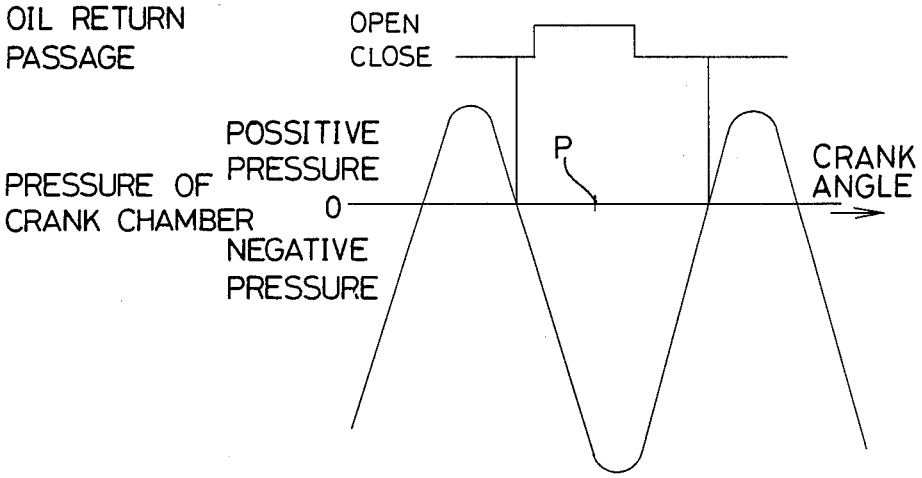
FIG. 5 is a graph showing a relation between pressure change in the crank chamber and closing/opening timings of an oil return passage in the third embodiment.

The third embodiment is described referring to FIG. 4. With this embodiment, a forced oil feeding is so designed as to be effected by a centrifugal force due to the rotation of the cam shaft 6 and by a negative pressure generated in the crank chamber 3. Namely, an oil return passage 23 consists of a first passage 23*a* extending along the axis and a second passage 23*b* extending outward in a radial direction. In a bearing section 1*a* of a crankcase 1 a communicating hole 25 radially extending from an internal surface of the bearing section is drilled to open to the crank chamber 3. The communicating hole 25 is circumferentially positioned so that the second passage 23*b* communicates with the communicating hole 25 when a pressure in the crank chamber 3 is negative. FIG. 5 shows a relation of pressure change in the crank chamber and closing/opening timing of the passage 23.

With the configuration as shown in FIG. 4, since a negative pressure in the crank chamber 3 helps to forcibly feed oil in addition to a centrifugal force due to the rotation of the cam shaft 6, the capability of forced oil feeding is further enhanced.

In this connection, the number of the above-described communicating holes 25 may be one or two having a phase difference of 180 degrees from each other, because a pressure in the crank chamber becomes negative twice for one rotation of the cam shaft 6 whose rotation speed is reduced to a half of that of the crankshaft 5 by the gears 7, 8.

And a combination of one communicating hole 25 and two second passages 23*b* having a phase difference of 180 degrees from each other can be employed.

As described above, this invention can provide:

(1) an enhanced efficiency of oil return to the crank chamber, because forced oil return passages are formed on or in a revolving shaft to forcibly return oil on the bottom of the oil separation chamber to the crank chamber, and the prevention of a blowby gas from directly flowing into the bottom section of the separation chamber from the crank chamber, thereby suppressing oil dispersion from the bottom section of the separation chamber.

As a result, the oil exhausted into the intake air line will be reduced, thus preventing not only the air cleaner from being fouled, blocked or oil dripped but also engine performance from deteriorating due to a lack of combustion air.

(2) A saving of oil consumption, because oil exhausted into the intake air line is reduced.

(3) A simple configuration eliminating the need for a special driving mechanism for forced oil returning, because the rotation of a revolving shaft helps oil to be returned forcibly. And, (4) a reasonable lubrication of the bearing sections of the revolving shaft, because a gap section is formed at the end face of the revolving shaft to communicate with the bottom section of the separation chamber.

What is claimed is:

1. In a breather device adapted for an internal combustion engine which includes a lubricant separation chamber having a check valve opening by a positive pressure in the crank chamber and being provided with at least one hole communicating said lubricant separation chamber with a crank chamber, a gas exhausting section connected to an intake air line and with means for returning a separated lubricant to the crank chamber, said lubricant return means comprising:

a gap section communicating to a bottom of said lubricant separation chamber and in contact with an end face of an appropriate revolving shaft, and at least one forced oil return passage being formed in or on said revolving shaft, which communicates the crank chamber to said gap section, and integrally revolves with said revolving shaft to forcibly send lubricant oil residing in said gap section to the crank chamber.

2. A breather device adapted for an internal combustion engine claimed in claim 1, wherein as said forced oil return passage constitutes a centrifugal type forced oil feed passage which reaches a circumferential surface of said revolving shaft from the center thereof as it goes to a downstream side.

3. A breather device adapted for an internal combustion engine as claimed in claim 1, wherein as said forced oil return passage includes a spiral groove formed on a circumferential surface of said revolving shaft.

4. A breather device adapted for an internal combustion engine as claimed in claim 1, wherein said forced oil return passage includes an outlet opening thereof disposed at a circumferential surface of a journal section of said revolving shaft, at least one communicating through-hole opening to the crank chamber being drilled in a bearing section supporting a journal section of said revolving shaft, and said communicating through-hole is so positioned that it communicates with said outlet opening when a pressure in the crank chamber is negative.

5. A breather device adapted for an internal combustion engine as claimed in one of claim 2 to claim 4, wherein said revolving shaft is a cam shaft.

* * * * *